United States Patent [19]

Schubert et al.

[11] 4,083,796

[45] Apr. 11, 1978

[54] DYE SYSTEM FOR SOAP AND SYNTHETIC DETERGENT BARS

[75] Inventors: Robert W. Schubert, Memphis, Tenn.; Thomas J. Hassapis, Scottsdale, Ariz.

[73] Assignee: Armour-Dial, Inc., Phoenix, Ariz.

[21] Appl. No.: 694,266

[22] Filed: Jun. 9, 1976

Related U.S. Application Data

[63] Continuation of Ser. No. 495,160, Aug. 6, 1974, abandoned.

[51] Int. Cl.[2] ..... C11D 9/22

[52] U.S. Cl. ..... 252/132; 252/90; 252/92; 252/93; 252/107; 252/108; 252/122; 252/125; 252/134; 252/370; 264/75

[58] Field of Search ..... 252/93, 107, 108, 122, 252/125, 134, 90, 92, 370, 132, DIG. 16; 8/93; 264/75

[56] References Cited

U.S. PATENT DOCUMENTS

| | | | |
|---|---|---|---|
| 1,852,137 | 4/1932 | Whitehead | 8/93 |
| 3,562,167 | 2/1971 | Ramen et al. | 252/134 |
| 3,769,225 | 10/1973 | Matthaei | 252/134 |
| 3,793,214 | 2/1974 | O'Neill et al. | 252/134 X |

*Primary Examiner*—Mayer Weinblatt

*Attorney, Agent, or Firm*—Frank T. Barber; Charles E. Cates; Richard G. Harrer

[57] ABSTRACT

A novel dye system and improvement to the conventional method of preparing highly colored soap and synthetic detergent bars is disclosed. In the making of soap bars, for example, a solution of water, glycerine and dye is added to soap pellets in the amalgamator along with a slurry of uncolored soap additives to produce a highly colored soap product, thus solving the problem of introducing high concentrations of dyes to soap pellets at the amalgamator, particularly in the presence of a slurry heavy with additives. This makes it feasible for one slurry tank to serve multiple amalgamators producing different highly colored bar products.

10 Claims, No Drawings

DYE SYSTEM FOR SOAP AND SYNTHETIC DETERGENT BARS

This is a continuation of application Ser. No. 495,160 filed Aug. 6, 1974, now abandoned.

BACKGROUND OF THE INVENTION

1. Field of the Invention

This invention relates to the dyeing of soap and synthetic detergent bars. In another aspect, this invention relates to the problem of increasing efficiency in the production of differently colored soap and detergent bar lots. In particular, the invention relates to the problem of introducing high concentrations of dyestuff to soap and detergents at the amalgamator in the presence of a slurry heavily laden with optional ingredients.

2. Description of the Prior Art

Generally the method of making bar soap products is as follows: Fatty acids are blended with caustic soda in saponification towers or boiled in soap kettles (in the older processes). The resulting flowable product, called neat soap, is pumped to a dryer where it is dried and scraped off in chip form. Thereafter the soap chips or pellets are sent to an amalgamator for blending with whatever soap additive a particular soap maker may want to include, such as for example, dyes, emollients and perfumes. The additives are carried in a slurry which has been mixed in a separate tank. The slurry vehicle (usually water) provides the additional moisture needed to blend the dry chips of neat soap and the additives to a homogeneous mixture. From the amalgamator the blended product is sent to a plodder in which it is further blended, compressed and ultimately extruded as a continuous ribbon of soap. The ribbon is cut into slugs which are then stamped and wrapped for market.

Traditionally, soap and synthetic detergent bars are white or pastel colored. In the art of making pastel bars, the dye is usually added in low concentrations at the amalgamator stage where the dispersion in the soap is accomplished by wetting the dye with the liquid soap and water.

Intensely-colored bars incorporating relatively high concentrations of dye have become popular in recent years and are now a small but valuable part of the market.

The problem if dyeing such bars was first approached traditionally, using the method previously known for dyeing pastel bars in the amalgamator; that is, wetting the dye with liquid soap and water. However, the bars thus made were speckled and streaked due to poorly dispersed and/or undissolved dyestuff. The problem was intensified by the presence of high concentrations of materials in the soap additive slurries commonly used to enhance the appeal of soap.

To avoid such problems, it was suggested that the high concentrations of the dye for the highly-colored bars be added to the slurry mixing tank.

The disadvantage in such a coloring method is that a separate slurry tank has to be used for each color of soap; whereas in the method for dyeing pastel soaps, one slurry tank could be used to make a master slurry to be fed to a number of almagamators. So, the change from the practice of introducing dye in the amalgamator to the practice of introducing dye in the slurry tank would require additional slurry tanks, additional factory space and additional personnel to operate the equipment.

It is, therefore, an object of this invention to provide a more efficient method for introducing in the amalgamator a high concentration of dye to homogeneously color soap pellets and synthetic detergents and combinations thereof.

It is further an object of this invention to provide a superior high-concentration dye system for use in dyeing soaps and synthetic detergents in the amalgamator.

SUMMARY OF THE INVENTION

It has been discovered that glycerine or a solution of glycerine and water can be used as a highly satisfactory agent for wetting high concentrations of dyes which can then be mixed with the slurry and soap (or synthetic detergent) chips in the amalgamator to yield a homogeneously colored product equivalent in quality to that produced by adding the dye to the slurry tanks.

According to the teaching of this invention, a master slurry of uncolored additives is prepared and processed to the amalgamator stage by known methods. At this stage there is added to the soap in the amalgamator, a suspension of dye in glycerine, or glycerine and water, prepared according to formulae exemplified in the following detailed description of the invention. Thereafter, the product manufacture is completed in the usual manner known to the art.

Among the advantages to the use of the method of this invention are that one slurry tank will serve a numer of amalgamators processing different colored bars; also, higher concentrations of dye can be added to soap at the amalgamator stage to produce high-intensity colors without speckling or streaking the soap and/or synthetic detergent bars. The glycerine also serves as an emollient and imparts a high gloss to a milled bar of soap or synthetic detergent.

The method is particularly useful when large amounts of optional ingredients are carried by the slurry of soap additives.

DETAILED DESCRIPTION OF PREFERRED EMBODIMENTS OF THE INVENTION

Utility

The compositions of this invention are useful in the dyeing of soaps and/or synthetic detergents. This invention improves the prior art method of making highly colored soap and detergent bars, making it possible to achieve homogeneous distribution of high concentrations of dye therein by adding the dye to the amalgamator.

Starting Materials

The dye systems of this invention contain commercial glycerine (96% glycerine and 4% water), preferably with some additional water, and a suitable dye. The dye system may contain, by weight, from about 2.5 to about 8.5 percent dye, from about 48 to 93.6 percent glycerine and from about 3.9 to about 44.7 percent water. Some examples of dyestuffs which are suitable for use in making the dye systems are:

D + C orange #4, D + C yellow #10 (95%)
D + C red #19, D + C green #5 (88%),
D + C blue #1 (91%)

Typical ingredients and proportions for making a slurry of uncolored soap additives are, according to weight percent:

| | |
|---|---|
| Triclocarban (germicide) | 47.6% |
| Linear Tridecylbenzene Sulfonate Slurry | 8.5% |
| Monostearic Hydrazide | 1.1% |
| Water | 42.8% |
| | 100.0% |

The neat soap and slurry of soap additives without dye is produced according to known methods and processed to the amalgamator stage where the dye system of this invention is added and mixed with the slurry and neat soap until a homogeneous, evenly colored product is obtained.

The following examples will serve to illustrate the practice of the invention as presently preferred.

EXAMPLE 1

A dye system having 6.56 grams of D + C orange #4 (92%), 8.06 grams of D + C yellow #10 (95%), 100.0 grams of glycerine (96%) and 85.38 grams of water was mixed and added, in the amalgamator, to 250 pounds of neat soap and 8 pounds of a slurry of soap additives, consisting of the following components in proportions by weight percent:

| | |
|---|---|
| Triclorcarban (germicide) | 47.6 |
| Linear Tridecylbenzene Sulfonate | 8.5 |
| Monostearic Hydrazide | 1.1 |
| Water | 42.8 |

The dried soap, soap additive and dye system were mixed until homogenized, resulting in a soap having an attractive, high intensity gold color, free of speckling and streaking, suitable for further processing at the plodder and to a finished product.

EXAMPLE 2

Using the method of Example 1, a dye system consisting of 11.43 grams of D + C red #19, and 188.57 grams of glycerine (96%) was added to the dried soap and soap additives of Example 1. The resulting product was an attractive, deeply hued pink soap free of speckling and streaking.

EXAMPLE 3

Using the method of Example 1, a dye system consisting of D + C green #5 (88%), 5.63 grams of, 6.19 grams of FD + C blue #1 (91%), 188.12 grams of glycerine (96%), was added to the dried soap and soap additives of Example 1. The resulting product was an intensely hued blue soap free of speckling and streaking.

EXAMPLE 4

Using the method of Example 1, a dye system consisting of 1.98 grams of D + C green #5 (88%), 3.95 grams of D + C red #19, and 198.74 grams of glycerine (96%) was added to 250 pounds of the dried soap and additives of Example 1. The resulting product was a deeply hued purple soap free of speckling and streaking.

EXAMPLE 5

Using the method of Example 1, a dye system consisting of 10.1 grams of D + C (88%), 6.78 grams of external D + C yellow #1 (95%), and 183.12 grams of glycerine (96%) was added to 250 pounds of dry soap and additives of Example 1. The resulting product was a deeply hued green soap free of speckling and streaking.

The foregoing method is also suitable for use with synthetic detergent bars and produces a product of high quality, intensely colored and free of speckling and streaking.

Although only the preferred embodiments have been given as examples in this disclosure, the scope of the claims are not intended to be limited thereby, and are to be interpreted according to, and limited only by, the attached claims.

What is claimed is:

1. In a soap and detergent bar manufacturing process including the coloring of soap and detergent pellets with high concentrations of dye, the improvements comprising the steps of selecting dye from the group consisting of D+C orange #4, D+C yellow #10 (95%), D+C red #19, D+C green #5 (88%), D+C blue #1 (91%), making a dye system consisting essentially of, by weight, from about 2.5 to about 8.5 percent of said dye, from about 48 to about 93.6 percent glycerine, and from about 3.9 to about 44.7 percent water, and adding said dye system to the soap or detergent to be dyed in an amalgamator, whereby there is produced homogeneous intensely colored soap and detergent bars.

2. The method of claim 1 where the dye selected is D+C yellow #10 (95%).

3. The method of claim 1 where the dye selected is D+C red #19.

4. The method of claim 1 where the dye selected is D+C green #5 (88%).

5. The method of claim 1 where the dye selected is D+C blue #1 (91%).

6. The method of claim 1 where the dye selected is D+C orange #4.

7. The method of claim 1 where the dyes selected are D+C green #5 (88%) and D+C blue #1.

8. The method of claim 1 where the dyes selected are D+C orange #4 (92%) and D+C yellow #10 (95%).

9. The method of claim 1 where the dyes selected are D+C green #5 (88%) and D+C red #19.

10. The method of claim 1 where the dyes selected are D+C green #5 (88%) and D+C yellow #1 (95%).

* * * * *